United States Patent [19]

Mackintosh

[11] 4,152,992

[45] May 8, 1979

[54] TRACK SWITCHING ARRANGEMENT

[76] Inventor: Charles Mackintosh, 3838 Oakwood Ave., Los Angeles, Calif. 90004

[21] Appl. No.: 847,066

[22] Filed: Oct. 31, 1977

[51] Int. Cl.[2] ..... E01B 25/06; E01B 25/26

[52] U.S. Cl. ..... 104/130; 104/118; 104/96

[58] Field of Search ..... 104/130, 131, 96, 102, 104/118, 120

[56] References Cited

U.S. PATENT DOCUMENTS

| | | | |
|---|---|---|---|
| 3,194,179 | 7/1965 | Scherer | 104/121 |
| 3,626,857 | 12/1971 | Omar | 104/119 |
| 3,926,126 | 12/1975 | Voss | 104/130 |

*Primary Examiner*—Robert G. Sheridan

*Assistant Examiner*—Frank F. Atwood

*Attorney, Agent, or Firm*—Watson, Cole, Grindle & Watson

[57] ABSTRACT

A switching arrangement for an elevated track having upper and lower rails includes a pair of first upper and lower switch beams at a switching interruption along the track, the beams being movable from a position of rail alignment with the upper and lower rails to a position shifted toward on another. For switching a rail vehicle to a secondary track, a pair of second upper and lower switch beams are provided at the switching interruption for movement toward and away from one another between a position out of rail alignment with the upper and lower rails to a position into alignment therewith when the first beams are shifted toward one another.

6 Claims, 6 Drawing Figures

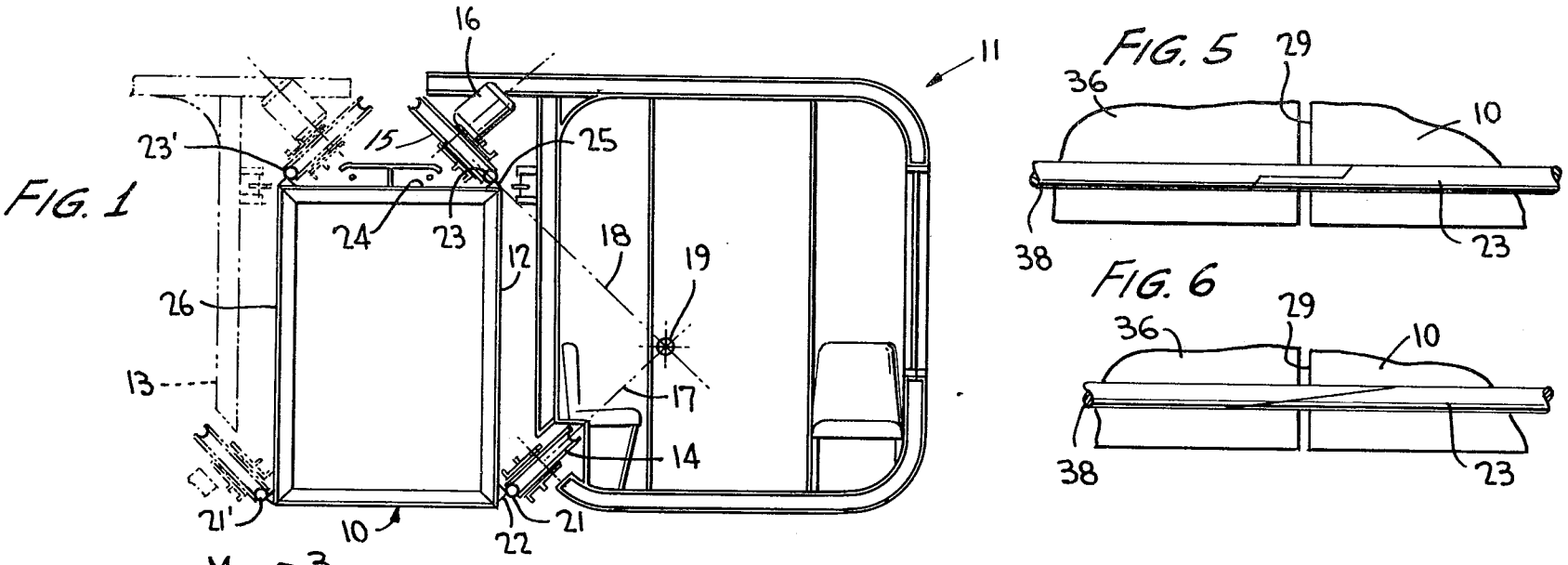
FIG. 1
FIG. 5
FIG. 6
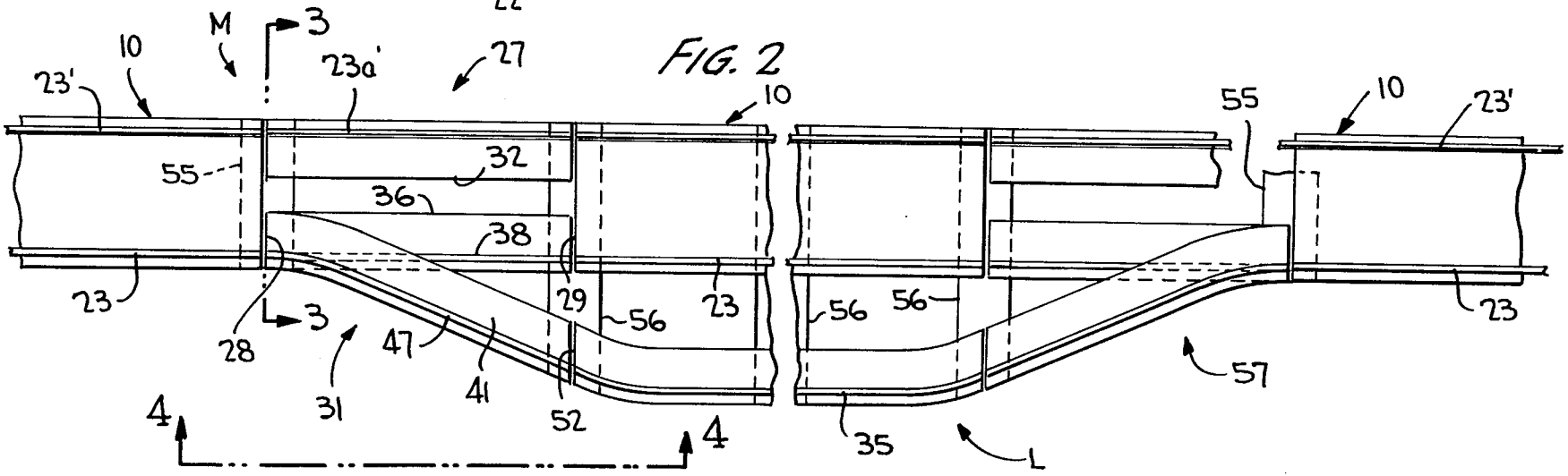
FIG. 2

TRACK SWITCHING ARRANGEMENT

BACKGROUND OF THE INVENTION

This invention relates generally to an elevated rail transportation system, and more particularly to a switching arrangement provided for such a system.

In my prior U.S. Pat. No. 4,000,702 an elevated rail transportation system is disclosed as including a track in the form of a continuous box beam having, in one embodiment, rails on the top and opposing side surfaces thereof for the support of elongated rail vehicles extending outwardly of opposite sides and having wheel means engaging the rails. The box beam is supported along spaced columns, and the rail vehicles are adapted for travel in the same or opposite directions along the track. Problems are, however, envisioned when switching or diverting the rail vehicle from a main line to a station, a spur, or a branch line without interfering with such lines during switching because of the vehicle's lateral extension from the rails. The railroad car switching art is highly developed for the switching of cars, having vertical wheels, from a pair of rails lying in a horizontal plane to another pair of rails lying in the same horizontal plane. The rails are supported on a full road bed from below. The generally known switching approach used in the railroad switching art is likewise adaptable for monorail switching wherein the rail cars are suspended from the monorails. Such a system is disclosed in U.S. Pat. No. 4,016,818. Other approaches have likewise been utilized for the switching of rail vehicles suspended from monorails, as disclosed in U.S. Pat. No. 3,926,126. These known rail switching techniques are, however, not available for switching a rail vehicle from a primary track, as shown in FIG. 1 of my prior patent mentioned above, to a secondary track because of the lateral extensions of the rail vehicles.

SUMMARY OF THE INVENTION

It is therefore an object of this invention to provide a switching arrangement for an elevated track having upper and lower rails supporting a rail vehicle extending laterally of the track, such an arrangement effecting the diversion of the rail vehicle between primary and secondary tracks in a simple and economical yet highly effective manner.

Another object of this invention is to provide such an arrangement wherein switch beams associated with both the primary track and the secondary track are shiftable for effectively switching the vehicle without interfering with the support columns or with the moving rail vehicles.

In carrying out these objectives a pair of spaced upper and lower switch beams are provided at an interruption in the primary track and are shiftable toward and away from one another from positions into and out of rail alignment with upper and lower rails of the track. A pair of spaced upper and lower second switch beams are provided for switching the rail vehicle from the primary track to a secondary track, and are shiftable toward and away from one another from positions out of and into rail alignment with the upper and lower rails of the track. Thus, when the rail vehicle is travelling along the primary track, the first beams are in rail alignment and the second beams are moved outwardly away from one another out of rail alignment. And, for switching the rail vehicle from the primary to the secondary track, the first beams are moved toward one another out of rail alignment while the second beams are moved toward one another into rail alignment.

The first and second beams are in the form of rectangular box beams having rails on the upper surfaces of the upper beams and rails on the side surfaces of the lower beams. The box beams are sufficiently strong to support both the vertical and torsional loads of the track, yet are sufficiently small not to interfere with the track support columns or with the rail vehicles.

Other objects, advantages and novel features of the invention will become more apparent from the following detailed description of the invention when taken in conjunction with the accompanying drawings.

BRIEF DESCRIPTION OF THE DRAWINGS

FIG. 1 is an end elevational view in general outline of a primary track with a rail car mounted to one side thereof;

FIG. 2 is a top plan view of primary and secondary tracks in general outline incorporating the switching arrangement according to the invention;

FIGS. 5 and 6 are side elevational views of different embodiments of rail joints between the switch beams and the track beams.

DETAILED DESCRIPTION OF THE INVENTION

Figure 4:
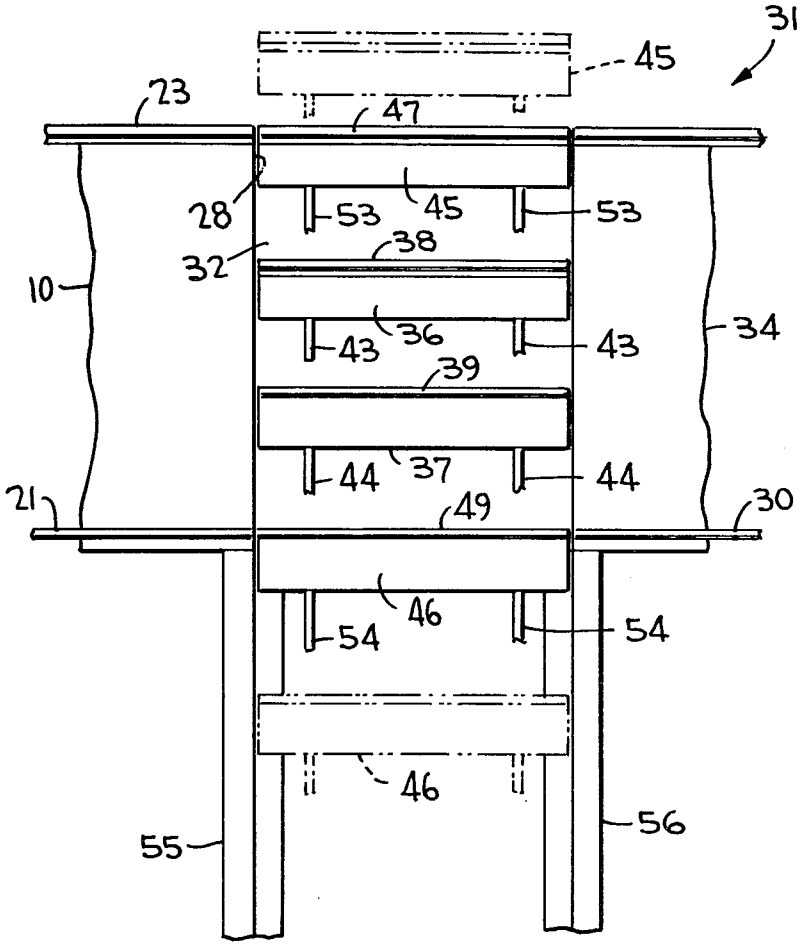
FIG. 4 is a side elevational view taken along line 4—4 of FIG. 2 showing the switching arrangement.

Turning now to the drawings wherein like reference characters refer to like and corresponding parts throughout the several views, a hollow box beam of rectangular section is generally designated 10 in FIG. 1 and comprises a portion of the primary track or main line M shown in FIG. 2. This box beam and rail vehicle 11 supported thereon are the same as that shown in FIG. 1 of my prior U.S. Pat. No. 4,000,702. The entirety of the disclosure of said patent is therefore specifically incorporated herein by reference.

Vehicle 11 extends laterally of a side 12 of the beam and is mounted for linear movement therealong. Another rail vehicle 13 is shown in part and in phantom outline mounted for linear movement along an opposite side 26 of the beam. A lower set of wheels 14 and an upper set of wheels 15 are mounted on vehicle 11 for rotation about their respective central axes, it being noted that lower and upper wheels are respectively mounted in pairs along the vehicle in any normal manner as by suitable wheel mounts. Power driving means, such as an electric motor 16, is operatively connected to the shaft of one of the wheels, such as 15, for rotating same so as to drive the vehicle along the beam. And, as in my aforementioned patent, the lower wheels lie in a single plane 17 and the upper wheels lie in a single plane 18 which planes are made to intersect together at a center of gravity 19 of vehicle 11.

A lower rail 21 of generally circular cross-section is mounted on side 12 of the box beam near the lower end thereof by means of V-irons 22 welded or otherwise connected to the box beam. Lower wheels 14 have rail engaging surfaces generally complementary in shape to that of rail 21, and are in rolling engagement therewith. Similarly, an upper elongated rail 23 of generally circular cross-section is mounted on a top surface 24 of the box beam near an end thereof adjacent side surface 12.

This rail is welded or otherwise mounted on V-irons 25 which are similarly welded or otherwise connected to surface 24, and rail engaging surfaces of the upper wheels are generally complementary in shape to the cross-sectional shape of rail 23 for rolling engagement therewith.

Rail vehicle 13 extends transversely outwardly of an opposite side surface 26 of the box beam, and has upper and lower wheels in rolling engagement with upper and lower rails 23' and 21' mounted as shown in FIG. 1 in phantom outline.

Referring to FIG. 2, the main line or primary track M is interrupted by a switch opening, and a secondary or lateral track L is spaced a predetermined distance from a side of the primary track sufficient to permit a rail vehicle, such as 11, to move continuously along the primary track without interference. Secondary track L is illustrative of a station, a spur or a branch line, and another similar secondary track may be provided along the opposite side of the primary track without departing from the scope of the invention.

The primary track is interrupted as at 27 shown in FIG. 2 so as to define opposing terminal ends 28, 29 of the primary track at the switching arrangement generally designated 31. Extending between ends 28 and 29 is a hollow substantially rectangular box beam 32 (FIG. 3) of generally the same height as beam 10 but of less than half the width thereof. This beam 32 forms a continuation of the primary track, and is welded or otherwise fixedly connected to ends 28 and 29. Otherwise, a switching arrangement similar to 31, to be more fully hereinafter described, may be substituted for beam 32 for effecting a diversion of the rail vehicle onto a secondary track which may be provided on a side of the primary track opposite that shown in FIG. 2. Beam 32 has an upper rail **23*a*' welded or otherwise secured to V-irons mounted on top surface 24*a* thereof similarly as in the manner shown in FIG. 1 for rail 23', and being in alignment with rails 23' of adjacent beams 10. A lower rail 21*a*' is mounted on a side surface 33 of beam 32, similarly as in the manner of rail 21', likewise in alignment with those rails on adjacent beams 10**.

The secondary or lateral track L comprises hollow box beam 34 similar in size and shape to that of beam 32 except that an elongated rail 35 of circular cross-section is mounted on the upper surface thereof at the opposite side of the track. Also, beam 34 is slightly curved at its ends.

Switching arrangement 31 generally includes a pair of spaced upper and lower hollow and generally rectangular switch beams 36 and 37 (FIGS. 3 and 4) of generally the same width as beam 32 but of a height substantially less than beam 32. These switch beams extend between terminal ends 28 and 29, and have continuous rails 38 and 39 of circular cross-section mounted respectively on upper surface 41 and on side surface 42 of beams 36 and 37 by means of V-irons. This first pair of switch beams are positioned such that their respective rails 38 and 39 are respectively in alignment with upper and lower rails 23 and 21 of adjacent beams 10 when the rail vehicle is to continue its travel along the primary tracks. These first switch beams are also mounted for shifting movement toward and away from one another between their positions shown in solid outline in FIG. 3 and their positions shown in phantom outline therein. The switch beams are locked in place into their solid outline positions by some suitable means (not shown) and are guided along some suitable means (likewise not shown) into their phantom outline positions. Piston and cylinder units 43 and 44 (FIGS. 3 and 4) are respectively provided for shifting beams 36 and 37 from a suitable power source. Of course, other generally known means for shifting these beams may be provided instead.

The switching arrangement further includes a pair of spaced upper and lower substantially rectangular and hollow second switch beams 45 and 46 each having a similar sectional profile to that of beams 36 and 37 but being slightly curved as shown in FIG. 2. An upper rail 47 is mounted on a top surface 48 of beam 45, while a lower rail 49 is mounted on a side surface 51 of lower switch beam 46. Both these rails are curved similarly as their respective beams. These second pair of beams extend between a terminal end 52 of beam 34 and end 28 of the primary track, and are mounted for shifting movement toward and away from one another between their positions shown in FIG. 3 in solid outline and their phantom outline positions shown therein. These second switch beams, when moved into their solid outline positions, are locked in place by some suitable means (not shown) so that their rails 47 and 49 are respectively in a position in alignment with adjacent upper and lower rails 23,35 and 21,30 of the respective adjacent beams 10 and 34 (FIG. 4). Piston and cylinder units 53 and 54 may be provided as a means for shifting beams 45 and 46 along suitable guide means (not shown), or other suitable shifting means may be provided instead. It can be seen that, in FIG. 3, switch beams 45 and 46 are disposed, when out of alignment with adjacent rails, sufficient distances respectively upwardly and below adjacent beams 36 and 37 so that the rail vehicle may pass without interference through the switching station.

Spaced columns and beams 55 and 56 support the tracks as shown and, another switching arrangement 57 is shown in FIG. 2 but will not be described in detail here since it is similar to that described for arrangement 31.

Figure 3:
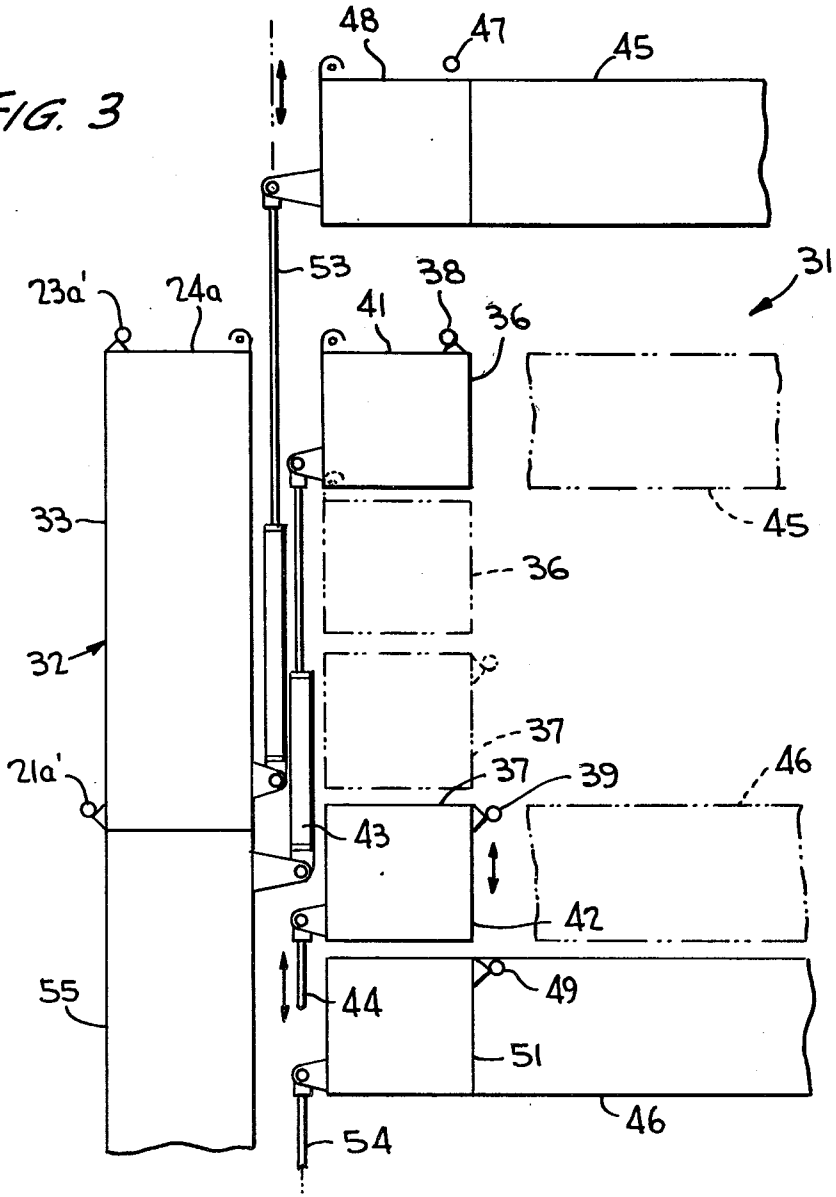
FIG. 3 is an end elevational view taken substantially along line 3—3 of FIG. 2 showing the switching arrangement of the invention.

In operation, when the travelling rail vehicle is not to be diverted from primary track M, switch beams 36 and 37 are shifted to their positions shown in solid outline in FIG. 3 wherein their rails 38 and 39 are made to respectively align with upper and lower rails 23 and 21 of the adjacent beams 10. Switch beams 45 and 46, in this condition, are disposed sufficient distances above and below their adjacent beams 36 and 37 so as to permit the rail vehicle, such as 11, to continue its travel along track M without interference. And, when it is desired to switch the rail vehicle onto secondary track L, switch beams 36 and 37 are shifted inwardly toward one another into their positions shown in phantom outline in FIG. 3, and switch beams 45 and 46 are likewise shifted toward one another into their positions shown in phantom outline in this Figure. In such position, also shown in solid outline in FIG. 4, rails 47 and 49 of these second pair of switch beams are positioned into alignment with the upper and lower rails of adjacent beams 23 and 34. And, with the pair of first switch beams 36 and 37 out of the way, the rail vehicle may proceed unimpeded onto or from the secondary track whichever the case may be.

FIG. 5 is a top plan view of the joint between beams 36 and 10 wherein terminal portions of rails 38 and 23 are shown reduced and of a complementary Z-shape so as to fit together when rails 38 and 23 are brought into alignment. Alternatively, the reduced end portions of rails 38 and 23 may, as shown in FIG. 6, be complementary sloped. Thus, when in an overlapping condition of FIG. 5 or FIG. 6, a smooth joint is effected between aligned rails to thereby avoid the noises otherwise apparent between jointed rails as in the past. The joints between the rails shown in FIGS. 5 and 6 are illustrative of joints between the switch rails and their adjacent rails.

From the foregoing it can be seen that a switching arrangement has been devised for an elevated side supported rail vehicle wherein switch beams are sufficiently small as not to interfere with the track support columns or with the rail vehicles during a switching operation, yet are strong enough to support both vertical and torsional loads. Since the switching tracks cannot be at the same level as the primary and secondary tracks, a pair of curved switch beams are disposed sufficiently above and below the level of the rail vehicle so that the vehicle travelling along the primary track will not collide with them. The straight switch beams are disposed for movement toward one another so that they are disposed out of the way to permit the curved switch beams to move into place.

Obviously, many modifications and variations of the present invention are made possible in light of the above teachings. It is therefore to be understood that within the scope of the appended claims the invention may be practiced otherwise than as specifically described.

I claim:

1. In a transportation system including a primary track interrupted along its length so as to define facing terminal ends, a secondary track spaced transversely of said primary track and having a terminal end adjacent one of said primary track ends, said primary and secondary tracks being in the form of rectangular box beams having rails of circular cross-section mounted on top and side surfaces thereof for engagement with wheel means mounted on an elongated vehicle adapted for travel along said tracks and extending transversely thereof, a track switching arrangement comprising, a pair of first track segments extending between said terminal ends of said primary track, said first track segments being in the form of rectangular box beams and having rails of circular cross-section respectively mounted on top and side surfaces thereof, said rails of said first track segments being respectively aligned with said rails of said primary track for interconnecting said terminal ends thereof, means for shifting said first track segments toward and away from one another for disconnecting and interconnecting said primary track terminal ends, a pair of second track segments extending between said terminal end of said secondary track and the other of said terminal ends of said primary track, said second track segments being in the form of rectangular box beams and having rails of circular cross-section respectively mounted on top and side surfaces thereof, means for shifting said second track segments toward and away from one another between a position wherein the rails thereof are in alignment with said rails of said primary and secondary tracks and a position out of alignment with said rails of said primary and secondary tracks when said first track segments interconnect said primary track terminal ends.

2. In the system according to claim 1, wherein said primary and secondary track rails have reduced portions of a predetermined shape at said terminal ends, said rails on said first and second segments also having reduced portions at opposite ends thereof of a shape complementary with said predetermined shape and overlapping with said reduced portions of said primary and secondary track rails when shifted into alignment therewith, whereby a smooth joint between aligned rails is effected.

3. A switching arrangement for an elevated track having upper and lower rails, the track including a primary section having a switching interruption defining facing terminal ends, comprising, a pair of first upper and lower switch beams extending between said ends and having rails thereon respectively alignable with said upper and lower rails, means for shifting said first beams toward and away from one another respectively out of and into rail alignment with said upper and lower rails, the track further including a secondary section having a terminal end adjacent one of said primary section terminal ends, a pair of second upper and lower switch beams extending between said secondary section terminal end and the other of said primary section terminal ends, said second beams having rails thereon respectively alignable with said upper and lower rails, means for shifting said second beams toward and away from one another respectively into and out of rail alignment with said upper and lower rails, whereby a rail vehicle having wheel means engageable with said upper and lower rails and extending transversely of said track may travel along said primary section when said first beam rails are shifted into alignment with said upper and lower rails, and whereby the vehicle may be switched from said primary section to said secondary section when said second beam rails are shifted into alignment with said upper and lower rails, without interference with said switch beams.

4. The arrangement according to claim 3, wherein said primary and secondary sections are in the form of rectangular box beams having said upper and lower rails mounted respectively on upper and side surfaces thereof.

5. The arrangement according to claim 4, wherein said first and second switch beams are in the form of rectangular box beams, said rails on said switch beams being respectively mounted on upper and side surfaces of said respective upper and lower beams.

6. The arrangement according to claim 3, wherein said rails are of circular cross-section having reduced portions of a predetermined shape at said terminal ends, said rails on said first and second beams also having reduced portions at opposite ends thereof of a shape complementary with said predetermined shape and overlapping with said reduced portions of said upper and lower rails when shifted into alignment therewith, whereby a smooth joint between aligned rails is effected.

* * * * *